US007914360B2

(12) United States Patent
Koonce, Jr. et al.

(10) Patent No.: US 7,914,360 B2
(45) Date of Patent: Mar. 29, 2011

(54) ILLUMINATED BALLOON

(75) Inventors: Nathaniel C. Koonce, Jr., Coral Springs, FL (US); Jesse P. Ponder, Jr., Miami, FL (US)

(73) Assignee: Patch-N-Light, Inc., Coral Springs, FL (US)

( * ) Notice: Subject to any disclaimer, the term of this patent is extended or adjusted under 35 U.S.C. 154(b) by 102 days.

(21) Appl. No.: 12/539,072

(22) Filed: Aug. 11, 2009

(65) Prior Publication Data

US 2010/0041303 A1 Feb. 18, 2010

Related U.S. Application Data

(60) Provisional application No. 61/188,774, filed on Aug. 13, 2008.

(51) Int. Cl.
*A63H 3/06* (2006.01)
*A63H 3/00* (2006.01)

(52) U.S. Cl. ..... 446/220; 362/352; 362/806

(58) Field of Classification Search ..... 446/220–226; 362/96, 186, 189, 352, 363, 806
See application file for complete search history.

(56) References Cited

U.S. PATENT DOCUMENTS 3,672,083 A * 6/1972 Moran ..... 40/540
5,075,830 A * 12/1991 Perez ..... 362/352
5,117,344 A 5/1992 Perez
5,947,581 A * 9/1999 Schrimmer et al. ..... 362/96
7,658,661 B2 * 2/2010 Ansolabehere ..... 446/220

* cited by examiner

*Primary Examiner* — Kien T Nguyen
(74) *Attorney, Agent, or Firm* — David W Barman

(57) ABSTRACT

A lighted assembly includes an inflated balloon, a light assembly affixed to a patch, and the patch affixed to the inflated balloon such that the light assembly is between the patch and the outer surface of the balloon.

4 Claims, 6 Drawing Sheets

ILLUMINATED BALLOON

INDEX TO RELATED APPLICATIONS

This application claims the benefit of U.S. Provisional Patent No. 61/188,174, filed Aug. 13, 2008, the disclosure of which is incorporated herein by reference in its entirety.

BACKGROUND OF THE INVENTION

The present invention relates generally to illuminated balloons, and more specifically, to an illuminated balloon having a translucent design on at a least portion of the balloon wherein light directed into the interior of the balloon from an externally attached electric lamp effectively illuminates the design.

Unlike many articles of manufacture, balloons have survived the test of time and continue to grow in popularity for use as gifts, displays, souvenirs, decorations, and the like. For years, balloons have been a source of visual enjoyment and entertainment, especially for children.

While most balloons, including the latex and the Mylar® type balloons, are particularly attractive in the daylight or other bright, well-lit atmospheres, their attractiveness cannot be fully appreciated at night or in dark places such as at the circus, evening sporting events, or simply outdoors during the evening hours. Unfortunately, these are the circumstances during which balloons are most often sold and meant to be enjoyed by the consumer and surrounding public.

There exists a need in the present balloon art for an illuminated balloon assembly adapted for use with virtually any known type of balloon wherein a light source is attachable to an outer surface of the balloon so as to direct light through an interior chamber thereof, illuminating the balloon and any design printed thereon. The light of the present balloon is positioned between a patch and the outer surface of the balloon.

SUMMARY OF THE INVENTION

The present invention is an illuminated display assembly, comprising:

a balloon having an inner surface and an outer surface defining a generally inflatable body and a neck portion integrally formed therewith, said inflatable body disposed in air tight, sealed relation about a hollow interior gas chamber, an electric lamp assembly attached to a patch;

said patch having a first side and a second side;

said second side of said patch having said electric lamp assembly attached thereto;

said second side of said patch further having adhesive disposed thereon, said adhesive for securing said patch to said outer surface of an inflated balloon;

whereby said electrical light assembly comprises an electrical light positioned on said second side of said patch such that said light is disposed between said patch and said outer surface of said inflated balloon;

said patch fixedly attached with adhesive to an outer surface of said inflatable body and structured and disposed to direct light into said interior gas chamber and at least partially out through said inflatable body, thereby effectively illuminating said balloon; and an electrical power supply, preferably comprising at least one battery. The battery may be any type of battery as is known.

The patch is made of any acceptable material that is substantially flexible including, but not limited to cloth, paper, polymers, combinations thereof, and the like.

The light is any light that produces illumination with minimal amount of heat generated. These include any electric component lamp device such as light emitting diodes (LED), electroluminescent wire (EL wire), plasma lights, organic light-emitting diodes (OLED), polymer light-emitting diodes (PLED), combinations thereof, and the like.

The assembly has an electrical power supply that includes a battery holder structured and arranged with a moveable tab accessible from the first side of said patch, whereby said moveable tab turns on and off said light. Preferably the light of the light assembly is wirelessly connected to the battery.

The assembly has a light supported by a light holder. The light on the light holder has an angular orientation relative to the patch such that said light holder forms an angle between 0°-60° relative to the inner surface of said patch. In a preferred embodiment, the angular orientation is about 45°.

The light is positioned between the patch and the outer surface of the balloon and is at least partially enveloped by the outer surface of the balloon.

The present invention is a fully integrated apparatus in a single patch that simply affixes to a balloon and illuminates the balloon when activated.

Additionally contemplated is a method of producing an enveloped illuminated balloon effect comprising the steps of:

a. providing an assembly according to claim 1;

b. moving said tab to turn on said light;

c. creating an enveloped illuminating effect on said balloon by virtue of said light, positioned between the patch and the outer surface of the balloon, being at least partially enveloped by the outer surface of the balloon.

A unique effect is produced from the light, held between the patch and the outer balloon surface. The present invention creates the "enveloped luminescent balloon effect." When the outer surface of the balloon at least partially envelopes the light, the light rays are altered and the enveloped luminescent balloon effect is created. It is a unique light patter in which light is scattered by virtue of a light being partially covered by the outer balloon surface and the light enveloped light passing through the balloon.

DETAILED DESCRIPTION OF THE PREFERRED EMBODIMENT

Figure 1:
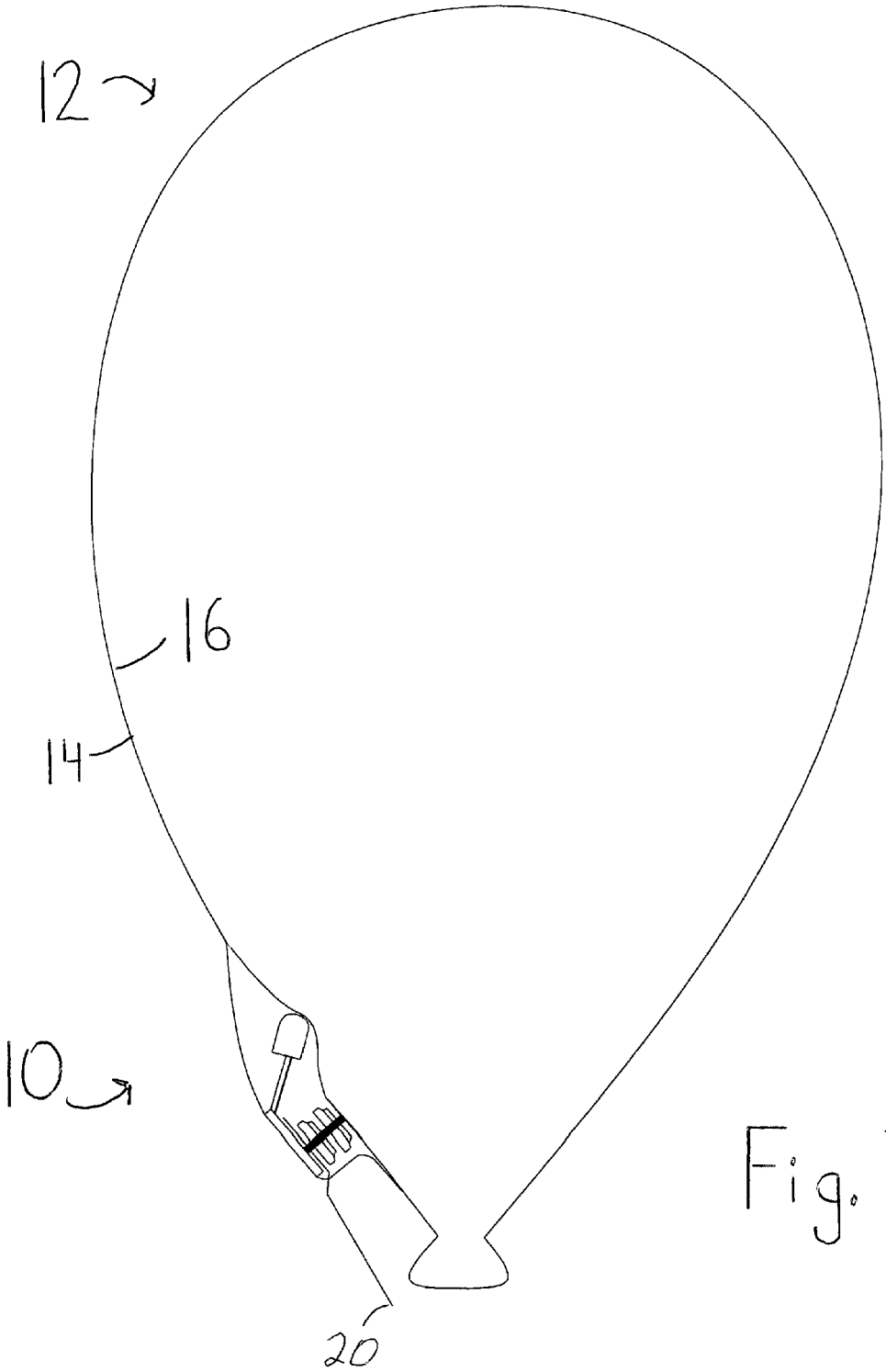
FIG. 1 is a side cross section view of the illuminated balloon assembly.
Figure 2:
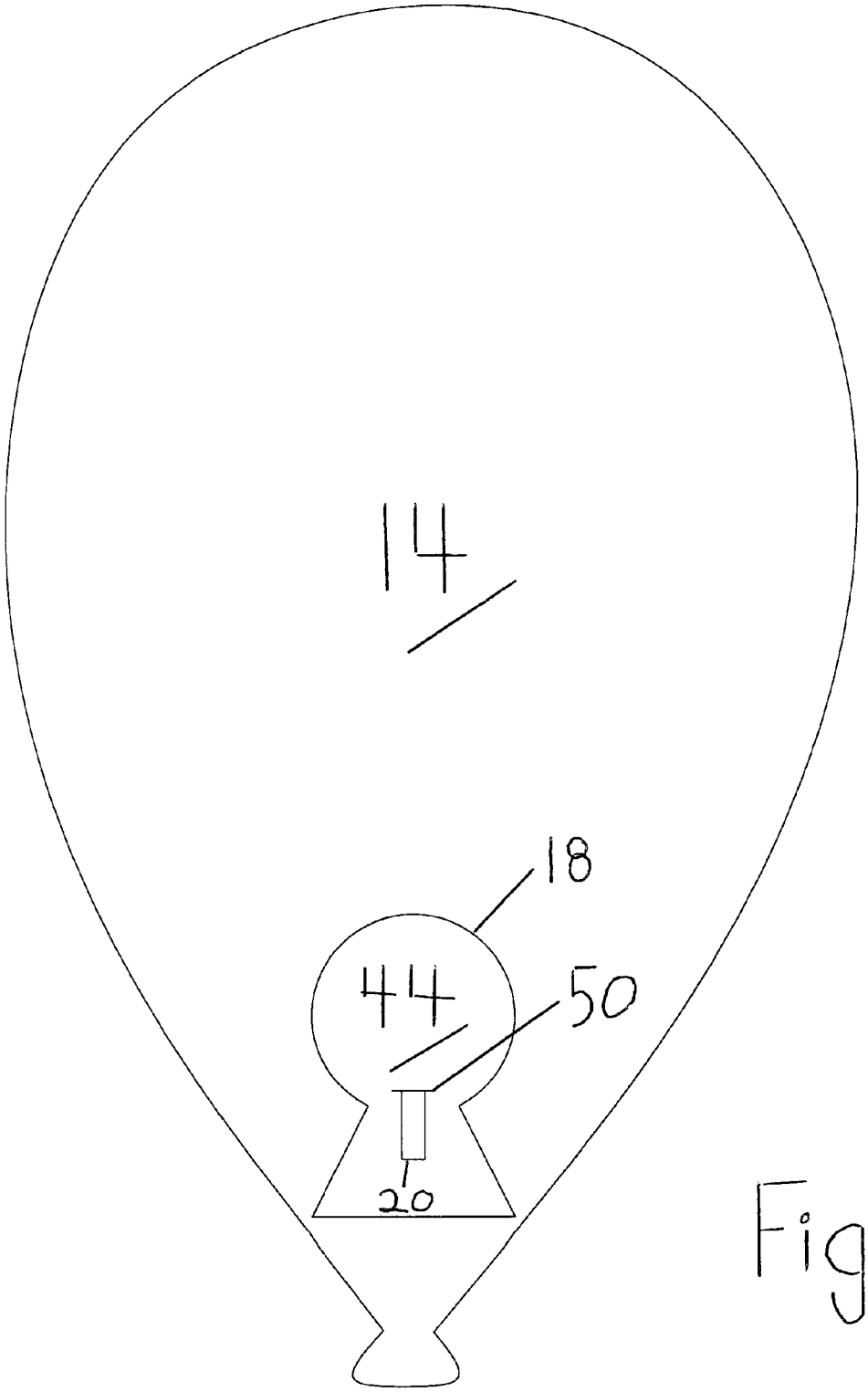
FIG. 2 is a front view of the illuminated balloon assembly.

The present invention is an illuminated balloon assembly 10. A balloon 12 includes an outer surface 14 and an inner surface 16. Patch 18 has a first side 44 and second side 46. A light assembly 40 is attached to second side 46 of patch 18. Assembly 40 includes a tab 21 with a first tab end 20 and a second tab end 22. Second tab end 22 is initially positioned between batteries 24 and electrical contact 26. Electrical contact 26 is on the inner side 42 of circuit board 28. Batteries 24 are urged towards contact 26 by battery encasement strap 34 that is connected both to circuit board 28 and battery encasement back 36. Compression tape 52 extends over battery encasement back 36 and secures to second side 46 of patch 18. Second side 46 has adhesive 48 disposed thereon. Circuit board 28 has light support arm 30 rigidly attached thereto. Light support arm 30 supports light 32 on the end of light support arm 30 that is opposite circuit board 28.

Figure 3:
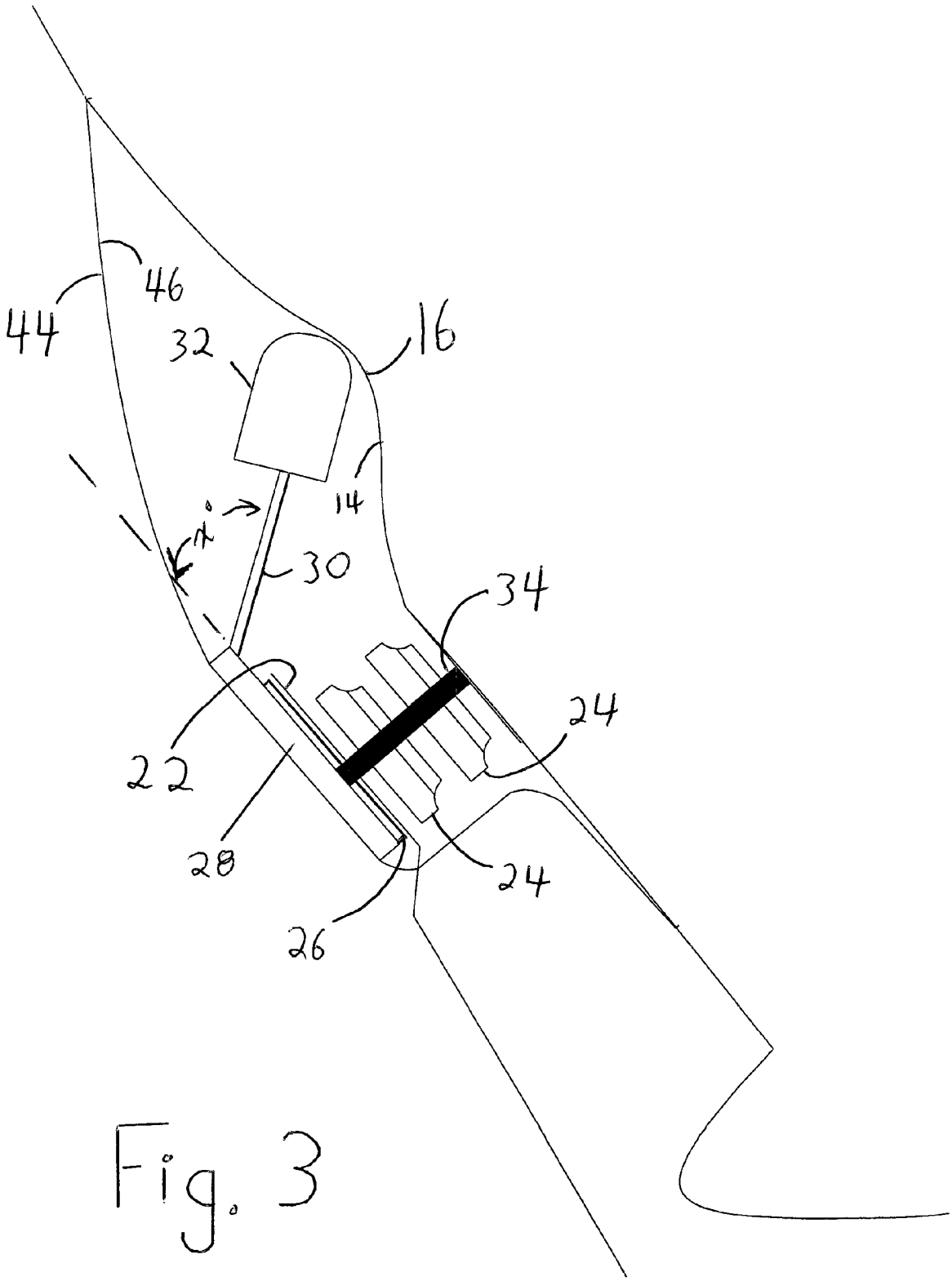
FIG. 3 is a side view cross section of the light assembly of the present invention with light positioned between a patch and the outer surface of a balloon.
Figure 4:
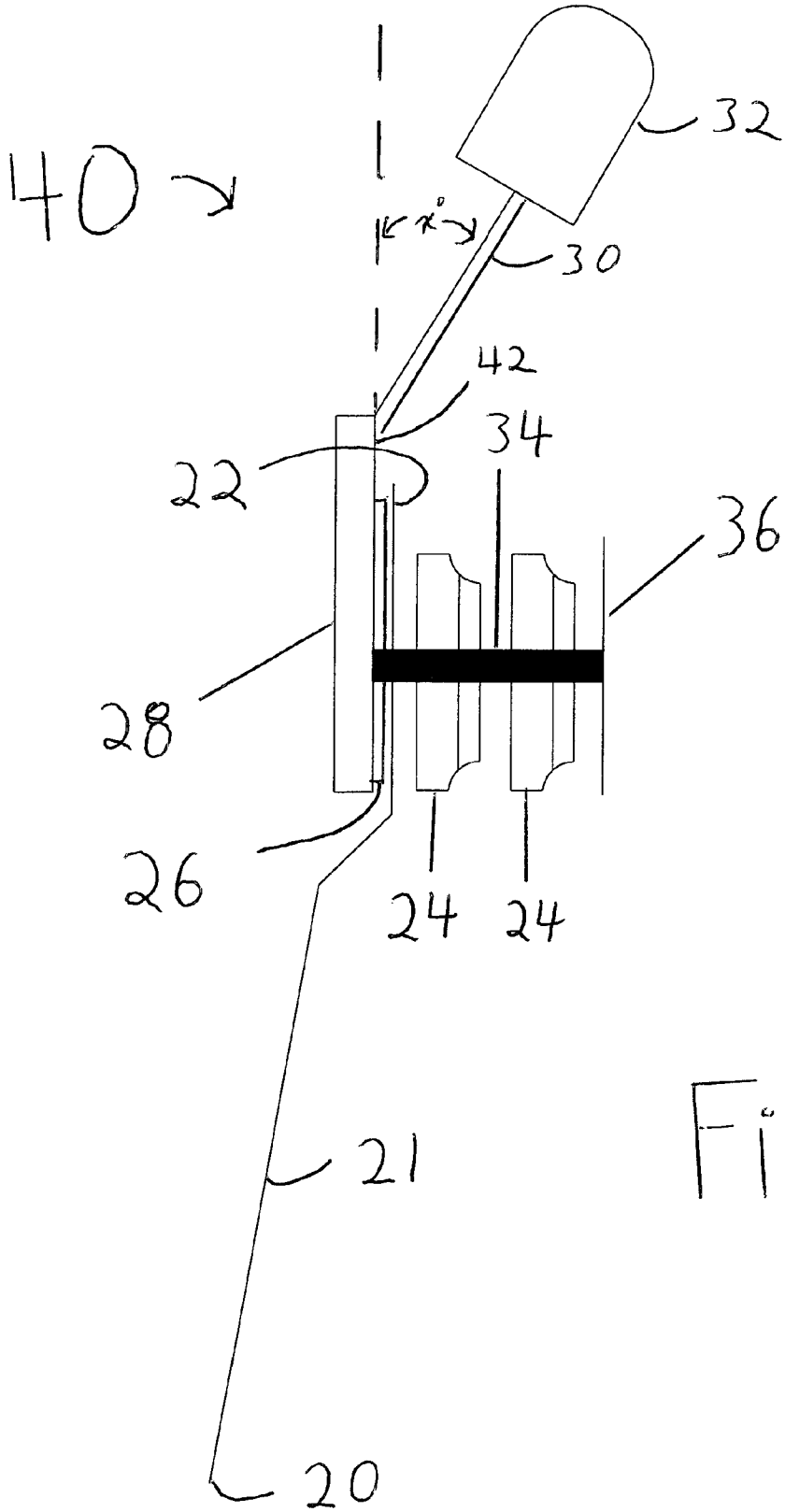
FIG. 4 is the light assembly.
Figure 5:
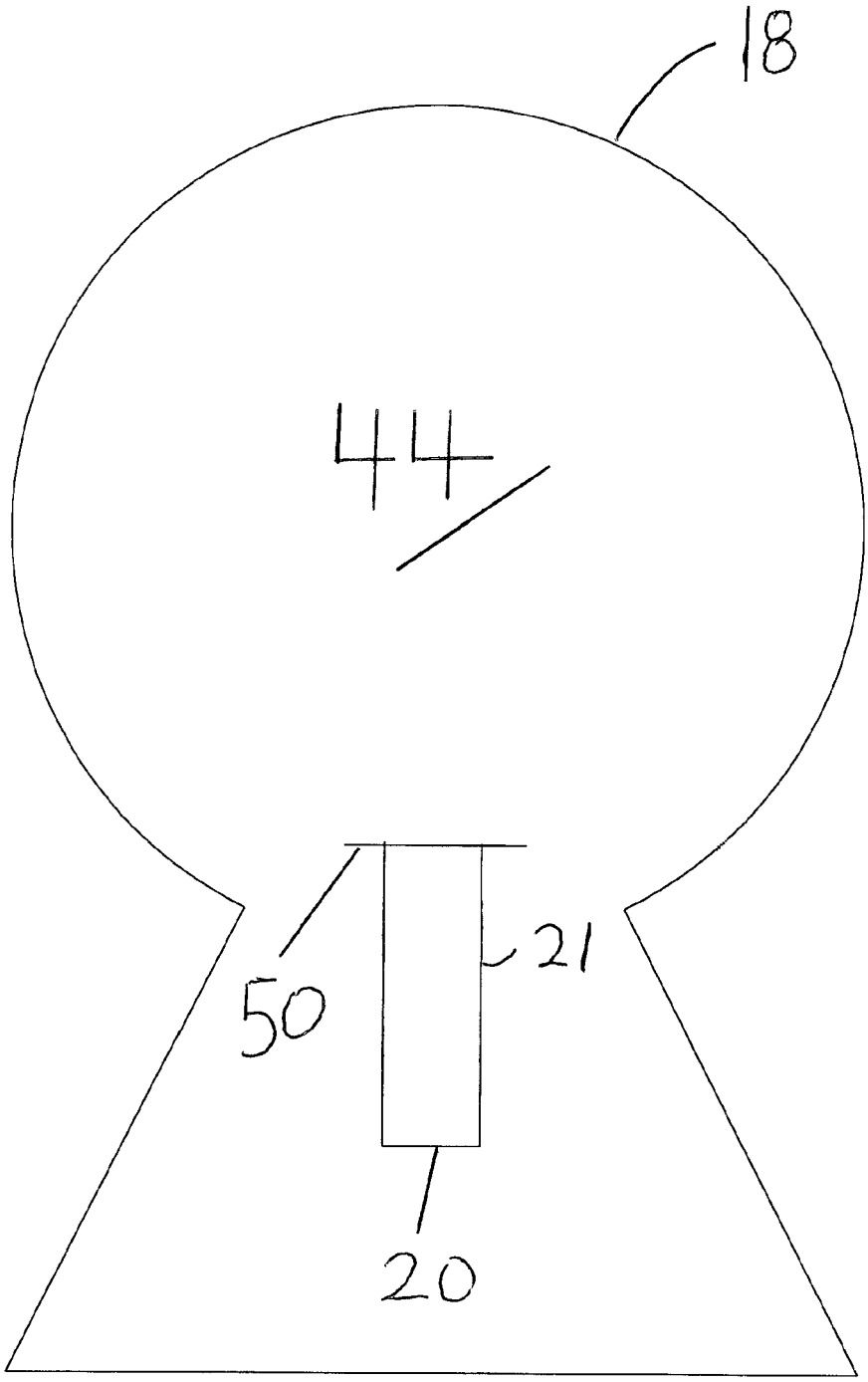
FIG. 5 is a plan view of the first side of the patch.
Figure 6:
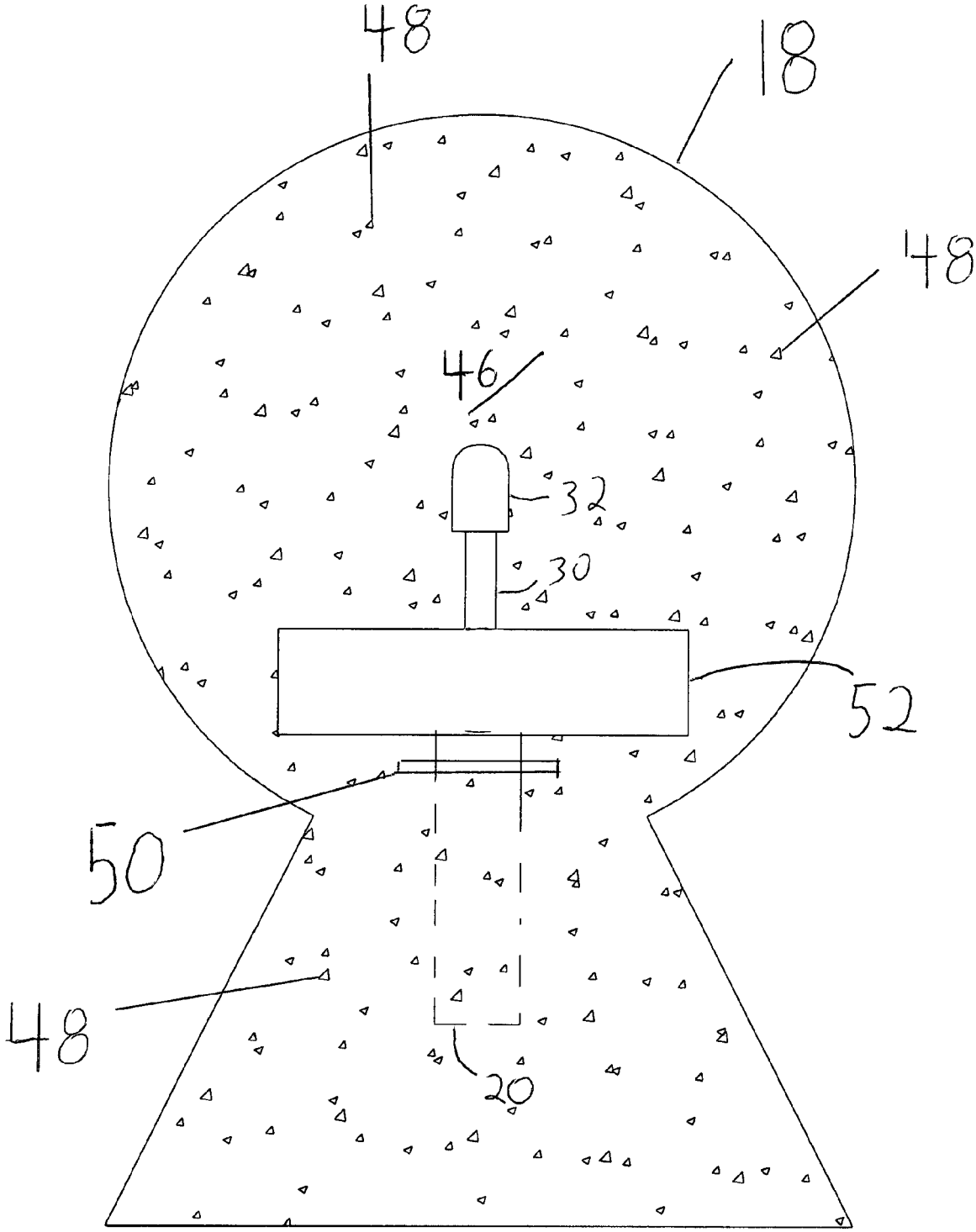
FIG. 6 is a plan view of the second side of the patch.

Assembly 10 includes light assembly patch 18. Patch 18 is attached to the outer surface 14 of balloon 12. Patch 18 has adhesive 48 disposed on second side 46 of patch 16. Second side 46 also has circuit board 28 attached thereto. In a preferred embodiment, second side 46 is formed of a reflective material. The securing of patch 16 to outer surface 14 of balloon 12 results in light 32 on light support arm 30 being pressed into the outer surface 14 of inflated balloon 12. Light support arm 30 has an angular orientation "x" relative to the surface of a substantially planer circuit board 28, as shown in FIGS. 3 and 4. Light support arm 30 is preferably oriented such that angle "x" is between about 0°-60°. In a preferred embodiment, the angular orientation of angle "x" is about 45°. The angular orientation is sufficient to urge light support arm 30 and light 32 such that each of light support arm 30 and light 32 press into the outer surface 14 of inflated balloon 12. The pressing of light support arm 30 and light 32 into outer surface 14 of inflated balloon 12 produces a lighted balloon effect that is unique over each of lights on the outer surface or lights contained on the interior of an inflated balloon. Outer surface 14 contacts and partially envelopes light 32 and produces a unique illuminated balloon effect that does not occur with either lights placed with an inflated balloon or lights placed on the outside of an inflated balloon.

Patch 18 is attached to balloon 12, such that tab 21 is accessible from second side 46 of patch 16. First end 20 of tab 21 extends outward from slot 50 of patch 18. Tab 18 is slidably movable by grasping first end 20 and moving tab 21. Movement of tab 21 ultimately moves second end 22 of tab 21. Second end 22 of tab 21 is positioned between batteries 24 and contact 26 of circuit board 28. In an extended orientation, end 20 is moved outward from patch 18 and second end 22 is moved from position between batteries 24 and connector 26. Thus, when second end 22 is moved from this position, batteries 24 are in direct contact with contact 26. The direct contact between batteries 24 and contact 26 initiates flow of electricity and illuminates light 32. In order to cease illumination of light 32, first end 20 of tab 21 is pushed inward towards balloon 12. Second end 22 of tab 21 is moved and positioned between batteries 24 and contact 26 of circuit board 28. The positioning of second end 22 of tab 18 between batteries 24 and contact 26 interrupts the flow of electricity to circuit board 28 and light 32 ceases to illuminate. Thus, movement of the tab 21 turns light 32 on and off.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. An illuminated display assembly, comprising:

a balloon having an inner surface and an outer surface defining a generally inflatable body and a neck portion integrally formed therewith, said inflatable body disposed in air tight, sealed relation about a hollow interior gas chamber;

an electric lamp assembly attached to a patch;

said patch having a first side and a second side;

said second side of said patch having said electric lamp assembly attached thereto;

said second side of said patch further having adhesive disposed thereon, said adhesive for securing said patch to said outer surface of an inflated balloon;

whereby said electrical light assembly comprises an electrical light positioned on said second side of said patch such that said light is disposed between said patch and said outer surface of said inflated balloon;

said patch fixedly attached with adhesive to an outer surface of said inflatable body and structured and disposed to direct light into said interior gas chamber and at least partially out through said inflatable body, thereby effectively illuminating said balloon; and an electrical power supply wherein said electrical power supply includes a battery holder structured and arranged with a moveable tab accessible from the first side of said patch, whereby said moveable tab turns on and off said light.

2. The assembly of claim 1 wherein said light is supported by a light holder.

3. The assembly of claim 1 wherein said light has an angular orientation relative to said patch such that said light holder forms an angle between 0°-60° relative to the inner surface of said patch.

4. The assembly of claim 1, wherein said light positioned between said patch and said outer surface of said balloon is at least partially enveloped by said outer surface of said balloon.

* * * * *